US007849824B2

(12) United States Patent
Ohlmann

(10) Patent No.: US 7,849,824 B2
(45) Date of Patent: Dec. 14, 2010

(54) TWO-STROKE INTERNAL COMBUSTION ENGINE WITH ENHANCED SCAVENGING

(76) Inventor: Hans-Armin Ohlmann, 22 Piper Street, Ayr, ON (CA) N0B 1E0

( * ) Notice: Subject to any disclaimer, the term of this patent is extended or adjusted under 35 U.S.C. 154(b) by 397 days.

(21) Appl. No.: 11/995,782

(22) PCT Filed: Jul. 14, 2006

(86) PCT No.: PCT/CA2006/001152

§ 371 (c)(1),
(2), (4) Date: Jan. 15, 2008

(87) PCT Pub. No.: WO2007/009223

PCT Pub. Date: Jan. 25, 2007

(65) Prior Publication Data

US 2008/0196701 A1 Aug. 21, 2008

Related U.S. Application Data

(60) Provisional application No. 60/699,401, filed on Jul. 15, 2005.

(51) Int. Cl.
*F02B 25/00* (2006.01)

(52) U.S. Cl. ..... 123/69 R; 123/65 VB

(58) Field of Classification Search ..... 123/65 VB, 123/65 B, 65 BA, 69 R, 69 V, 70 R, 70 V, 123/71 V, 73 AB, 73 BA, 73 CA, 68
See application file for complete search history.

(56) References Cited

U.S. PATENT DOCUMENTS 744,881 A 11/1903 Sohnlein
2,091,451 A * 8/1937 Phillips ..... 123/21
2,381,646 A * 8/1945 Carter ..... 123/69 V
5,277,222 A 1/1994 Clarke
6,170,444 B1 1/2001 Ohlmann

FOREIGN PATENT DOCUMENTS

EP 0952334 A2 10/1999
WO 96/07817 A1 3/1996
WO 2005/052417 A2 6/2005

* cited by examiner

*Primary Examiner*—Noah Kamen
(74) *Attorney, Agent, or Firm*—Brooks Kushman P.C.

(57) ABSTRACT

The engine has at least one cylinder (2) each with at least one and preferably multiple air intake valves (25', 1) into the cylinder, and at least one exhaust port (51) at a lower position above the bottom position of the piston (53). A blower (4) is arranged to force air into each cylinder via each intake valve as the piston moves around the bottom position, the blower not supplying enough pressure to keep each intake valve open during upward motion of the piston, such that during upward motion of the piston, compression occurs within each cylinder, and such that during downward motion of the piston the blower forces air into each cylinder via each intake valve once each exhaust port is uncovered by the downward motion, and out of each cylinder via each exhaust port. The air intake valves are positively actuated by controlled air pressure differentials, for example by each intake valve having a valve disk (85) to close against a valve seat (1), a valve shaft (86), and lower and upper guide disks (87, 88). The lower and upper guide disks run in guide bores (89) and act as actuating pneumatic pistons, the guide bores extending between an air supply chamber (3) receiving air from the blower and a vacuum plenum (84). The guide disks thereby respond to a pressure differential between the vacuum plenum and the air supply chamber to actuate the valve.

7 Claims, 4 Drawing Sheets

TWO-STROKE INTERNAL COMBUSTION ENGINE WITH ENHANCED SCAVENGING

CROSS-REFERENCE TO RELATED APPLICATION

This application claims the benefit of U.S. provisional application Ser. No. 60/699,401 filed Jul. 15, 2005.

FIELD OF THE INVENTION

This invention relates to a two-stroke internal combustion engine, and in particular to an air supply and exhaust gas discharge (scavenging) system.

The invention is an improvement based on existing U.S. Pat. No. 6,170,444 ("the prior invention") by the same inventor.

BACKGROUND ART

A major problem in two-stroke engines is the process of purging exhaust gases and, during the same stroke, providing combustion air. The process of purging the exhaust gases is commonly referred to as "scavenging". Although fuel injection systems mitigate this problem to some extent, proper scavenging is indispensable for achieving high efficiency and low exhaust emissions.

A problem with scavenging in conventional two-stroke engines has been to prevent these two gas masses from mixing, with all the well-known resulting drawbacks regarding fuel efficiency and emissions. This problem was addressed by the prior invention.

In the prior invention, scavenging was achieved by locating at least one and preferably a number of air intake valves in the head of each cylinder, and at least one and preferably a number of exhaust gas discharge openings in the lower cylinder walls. The air intake valves were controlled solely by air pressure differentials, generated by fluctuating pressure inside the cylinder on one side and in the air supply chamber on the other side. When the piston rim cleared the exhaust openings on its downstroke, pressure in the cylinder decreased below the pressure in the air supply chamber, causing the air intake valves to open and allow for the inflow of scavenging air. A scavenging blower was used to force air into the air supply chamber and thence through the valves, in order to more effectively purge the exhaust gases form the cylinder as the piston descended. This arrangement can operate in an internal combustion engine utilizing either the Diesel or Otto processes.

Test results with a prototype engine according to the prior invention are very encouraging. However, it has been realized that notwithstanding excellent results to date, further improvement is possible.

In particular it has been realized that it would be beneficial to assist the passive valve check bodies of the prior invention to close more promptly after the upward-moving piston has closed the exhaust ports. This would increase the crankshaft angle available to compression, and thus facilitate a higher effective compression ratio in the combustion chamber.

DISCLOSURE OF INVENTION

In view of the above, it is an object of the invention to provide an improved scavenging system for two-stroke internal combustion engines, including particular system components and component configurations. More specifically, it is an object of the invention to provide certain improvements to the engine described in the prior invention, particularly in relation to scavenging, while maintaining most or all of the traditional advantages of two-stroke engines.

The inventor has recognized that controlling the timely closure of the check bodies will improve upon the prior invention, and enhance the fuel efficiency of the engine and increase its specific power output. It is of course desirable to do so without sacrificing the genuine advantages of two-stroke engines, e.g. simplicity, smaller size and mass, cost-effective production, etc.

Two-stroke engines using forms of uni-flow scavenging regimes are known, but the advantages are partially sacrificed by incorporating exhaust valves controlled by camshafts, as in four-stroke engines.

In engines according to the prior invention, mechanically actuated check bodies, although technically feasible, are generally out of the question due to lost simplicity and high costs. Although other methods of actuating the check bodies are conceivable, e.g. by individual solenoid coils, again there would be lost simplicity and high cost.

Therefore, in the invention, a pneumatic actuating system is employed, using the principles and certain features of the prior invention, e.g. the external generation of the scavenging air via a blower, with particular modifications to certain features of other components of the prior invention, including the check bodies and the cylinder head.

Accordingly, the engine has at least one cylinder with a piston mounted therein for reciprocal motion between a top position and a bottom position. Each cylinder has at least one and preferably multiple air intake valves into the cylinder, to allow air into the top of the cylinder, and at least one exhaust port at a lower position above the bottom position of the piston. A blower is arranged to force air into each cylinder via each intake valve as the piston moves around the bottom position, the blower not supplying enough pressure to keep each intake valve open during upward motion of the piston, such that during upward motion of the piston, compression occurs within each cylinder, and such that during downward motion of the piston the blower forces air into each cylinder via each intake valve once each exhaust port is uncovered by the downward motion, and out of each cylinder via each exhaust port. In the invention, the air intake valves are positively actuated by controlled air pressure differentials.

The preferred embodiment of the invention is aimed at providing an internal combustion engine with a potential power output of 100 HP to 300 HP, for example, using a modular engine design with, for example, 2, 3, 4, or 6 cylinders with displacements of 1.0 L to 3.0 L, as required. However, the invention is not limited to specific numbers or sizes of cylinders or specific power outputs. Ideally, the invention would allow two-stroke engines to perform comparably to similar four-cycle engines, while remaining lighter, simpler and more cost-effective than their four-cycle counterparts.

The preferred embodiment of the invention not only decreases the response time of the valve check bodies during the compression phase, but also allows for the creation of a cleaner combustion chamber, with a smooth surface of the cylinder head opposite to the piston, eliminating small cavities around the check bodies, which represent some undesired dead space.

Further details of the invention will be described or will become apparent in the course of the following detailed description and drawing of a specific embodiment of the invention, as an example.

BRIEF DESCRIPTION OF THE DRAWINGS

A preferred embodiment of the invention will now be described, by way of example only, with reference to the accompanying drawings, in which.

DETAILED DESCRIPTION OF THE INVENTION

The Prior Invention

The prior invention is fully described in the inventor's prior U.S. Pat. No. 6,170,444, which can be referred to for additional information. However, the prior invention is summarized below for convenience.

Figure 1:
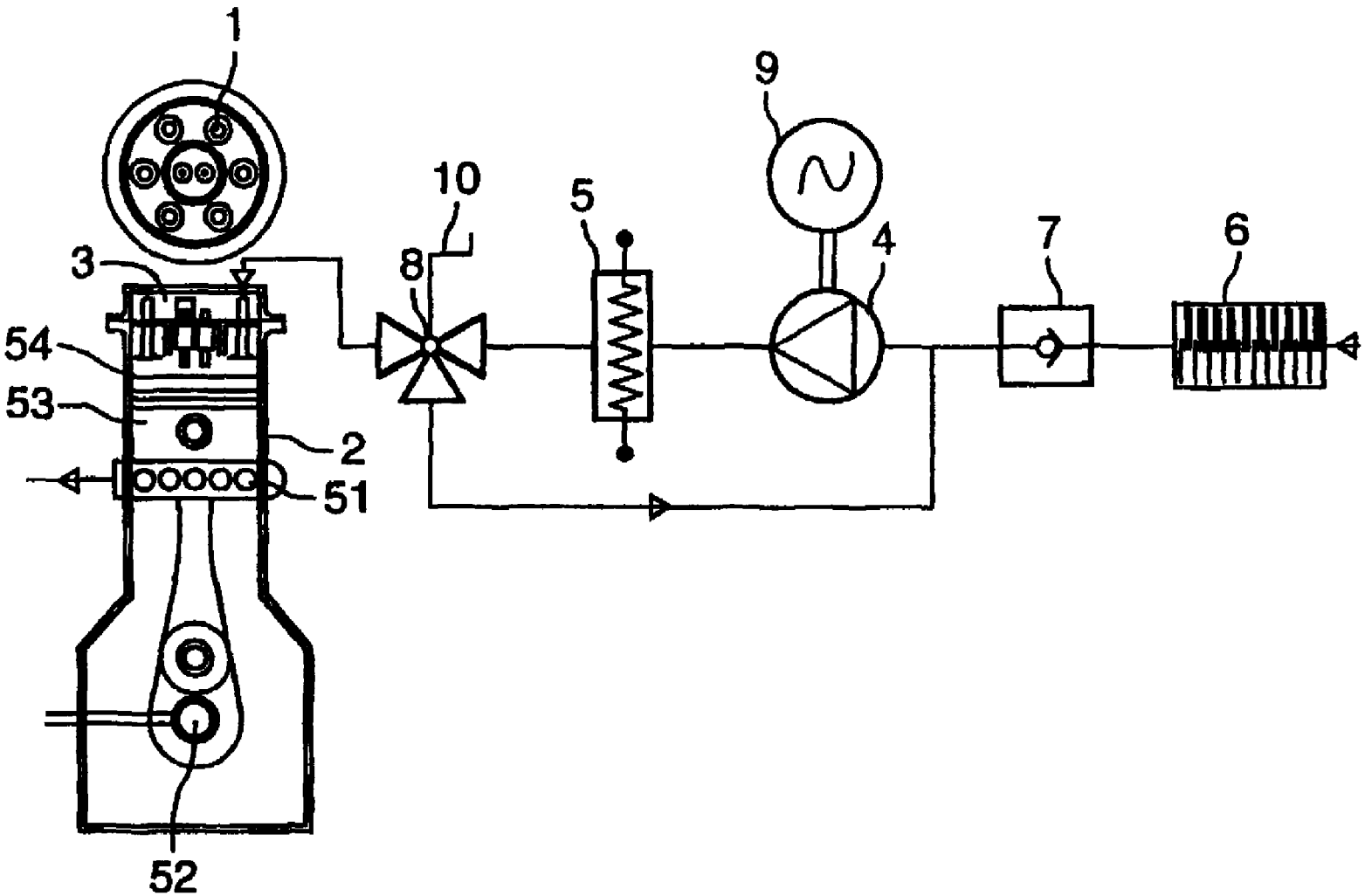
FIG.1 (PRIOR ART)
FIG. 1 (prior art) is a schematic illustration of an embodiment of the prior invention.
Figure 2:
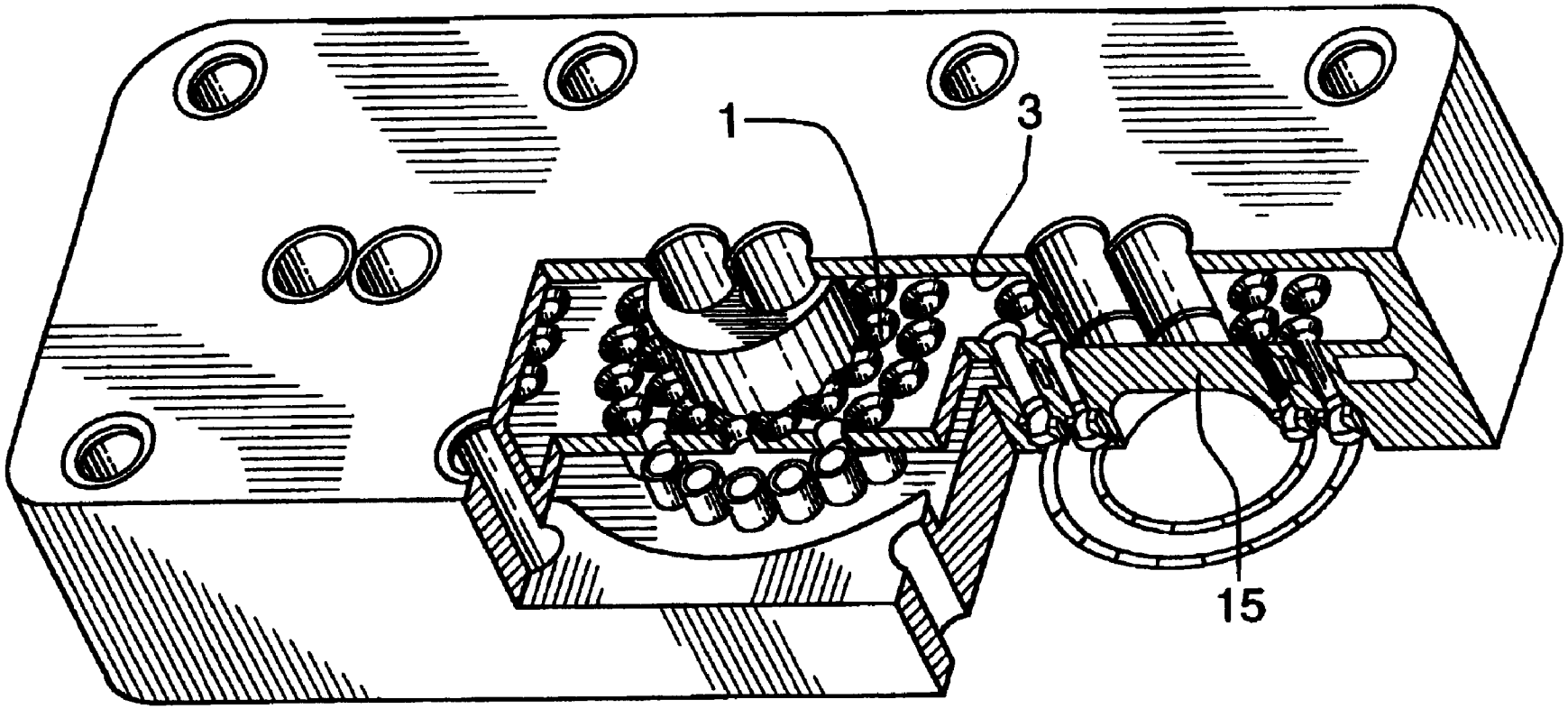
FIG.2 (PRIOR ART)
FIG. 2 (prior art) is a perspective view showing the air supply chamber of the prior invention, with a multitude of air intake valves arranged in concentric circles in the cylinder head.
Figure 3:
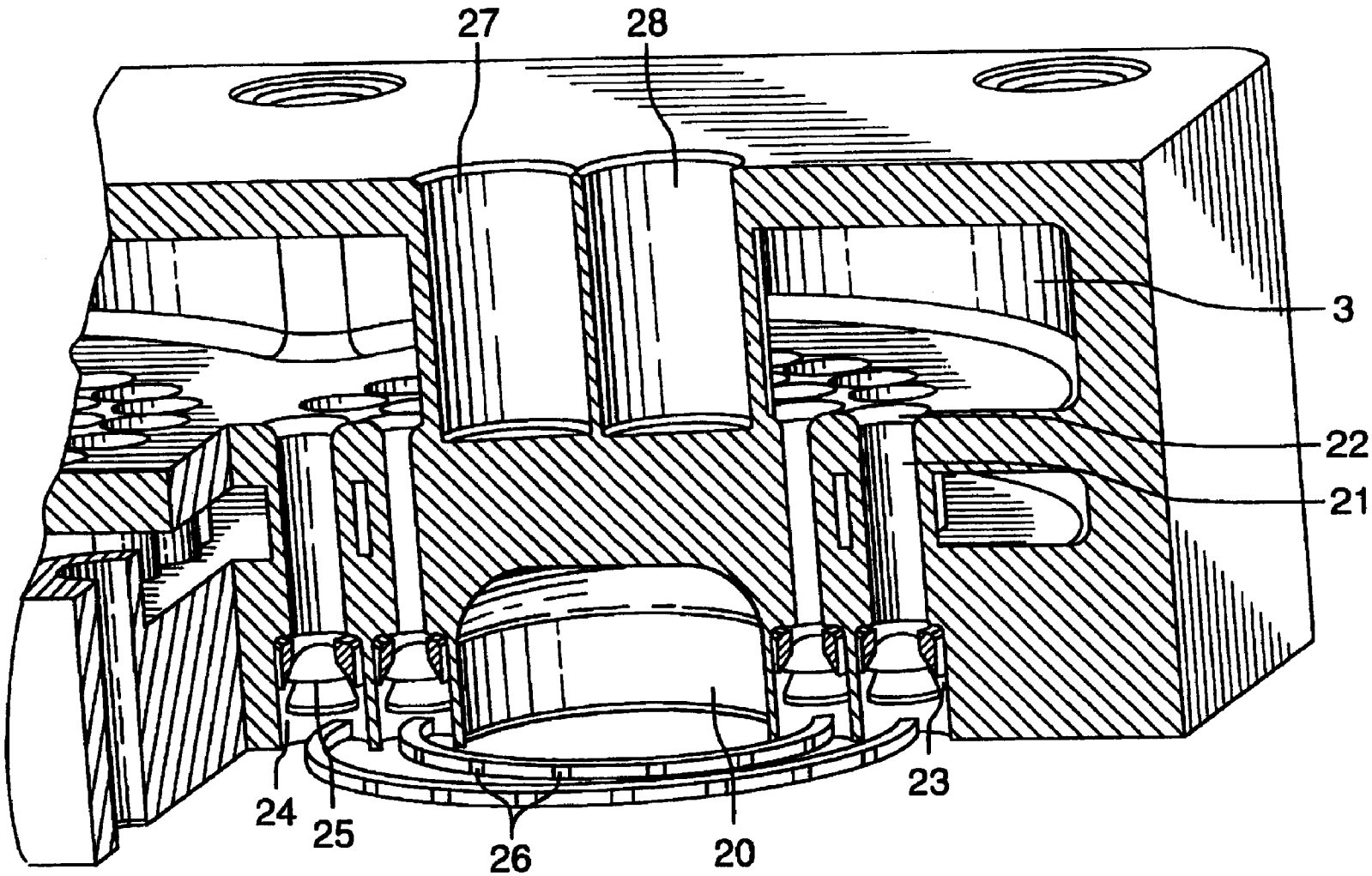
FIG.3 (PRIOR ART)
FIG. 3 (prior art) is a cut-away perspective view of the engine block of the prior invention, in the area above one of the cylinders.

FIGS. 1-3 show an embodiment of the prior invention.

In the prior invention, air intake valves 1 provide passageways between each cylinder 2 and an air supply chamber 3. The air intake valves are activated and controlled solely by air pressure differentials created by fluctuating pressure inside the cylinder on one side of the valves, and in the air supply chamber on the other side of the valves.

A scavenging blower 4 is provided to purge the exhaust gases and, at the same time, to charge the engine with air. Depending on the desired characteristics for the engine, the scavenging blower can be a low pressure type which is just able to overcome the resistances of the air and gas flow channels in order to provide proper scavenging only. Alternatively, a high pressure scavenging blower could be used to provide for pre-compression in the cylinder, for enhanced power output. This high pressure scavenging blower could be coupled with a conventional intercooler 5 to enhance the pre-charging effect.

Because the expansion phase must provide the working stroke in a two-stroke engine, it is desirable to leave the exhaust ports closed for as much of the downstroke as possible. The use of a blower for scavenging improves performance by permitting the opening of the exhaust ports to be delayed without resulting in ineffective scavenging.

The scavenging blower 4 is driven by an electrical servo motor 9 which allows the scavenging blower to immediately respond to changing operating conditions of the engine without being dependent on engine operating conditions such as the revolutions of the crankshaft or the energy content of the exhaust gas. Accordingly, the scavenging blower is driven by the servo motor and is controlled, for example, by a computer program designed to optimize the function of the scavenging blower. The servo motor provides the necessary electronic feedback to the computer program.

As shown in FIG. 1, the air drawn into the scavenging blower preferably first passes through a conventional air filter 6 and a check valve 7. Before the air reaches the three-way diverter valve 8, the air may pass through a conventional intercooler 5 if increased power output from the engine is desired.

The three-way diverter valve 8 is located between the intercooler 5 and the air supply chamber 3. Alternatively, if the engine does not include an intercooler, the three-way diverter valve will be located between the outlet of the blower 4 and the air supply chamber. The three-way diverter valve allows more efficient management of the interaction between the scavenging blower and the combustion engine.

The three-way diverter valve is linked to the accelerator 10, such that when the accelerator is depressed and full power is called for, the three-way diverter valve offers unrestricted air flow to the air supply chamber, and when the engine is idling, the air flow is partially directed back to the suction side of the scavenging blower. Alternatively, transducers (not shown) for air pressure and air flow may be incorporated as part of the air supply system to provide feedback to the electronic control system. In an alternative embodiment, the variable position of the three-way diverter valve can be controlled by a second small servo motor (not shown). The control system for this second servo motor receives feedback from an electronic position encoder configured to detect the position of the accelerator.

FIG. 2 shows the air supply chamber 3 with a multitude of identical air intake valves 1 arranged in concentric circles around the top of each cylinder. The air intake valves penetrate the divider wall 15 in the cylinder head between the air supply chamber and the cylinders. As seen in FIG. 3, the air intake valves encircle the combustion chamber 20 located at the center of each cylinder.

FIG. 3 also shows that an air intake valve consists of an inlet bore 21 with rounded bore edges 22 and an outlet bore 24. In the preferred embodiment, the inlet bore has a diameter of 7 mm and the outlet bore has a diameter of 11 mm. A ring-shaped seat 23 is located in the outlet bore adjacent to the inlet bore. A check body 25 floats freely in the outlet bore and is retained by the seat ring 23 in the up direction and by concentric retainer rings 26 in the downward direction. The check body is allowed freedom to move axially away from the ring-shaped seat by a sufficient distance to open a channel to permit air flow. In the closed position, the check body abuts against the ring-shaped seat, essentially eliminating air flow. The retainer rings concentric to the cylinder axis have a trapezoidal cross-section, and are fitted within grooves of a complementary trapezoidal shape in the lower plain of the cylinder head. Two bores 27 and 28 penetrate the dividing wall between the air supply chamber and the cylinder to accommodate a spark plug and fuel injection nozzle, respectively.

The check body 25 in the prior invention has a mushroom shape, with a semi-spherical head facing the inlet bore, attached to a conical stem.

In addition to locating the air intake valves in the cylinder head, as described above, exhaust gas openings must be located near the bottom of the cylinder in order to achieve the straight flow scavenging system. As depicted schematically in FIG. 1, exhaust ports 51 are located through the lower cylinder walls near the lowest position of the upper rim 54 of the piston 53, when the crankshaft 52 is around the bottom dead center. The exhaust ports preferably are in the shape of radial slots, although that is not specifically illustrated in FIG. 1.

When the upper piston rim clears these exhaust ports on the down-stroke, the pressure in the cylinder will decrease below the pressure in the air supply chamber, causing the air intake valves to open and allow the scavenging air to enter the cylinder. The scavenging air will drive the exhaust gases out of the cylinder via the exhaust ports. Because at least 50% of a cylinder's circumference remains available for scavenging even in an engine with more than one cylinder, the height of the exhaust ports can be quite small so that, unlike a conventional two-stroke engine, little of the crankshaft angle has to be sacrificed to scavenging. This, in turn, contributes to improved overall engine performance.

As mentioned above, the inventor's prior patent provides additional details.

The Present Invention

In the prior invention, there are multiple valve check bodies in the cylinder head of the engine. In a one-cylinder test engine produced in accordance with the prior invention, there are sixteen check valve bodies, for example. Given their locations, and their arrangement in two concentric circles, it would be quite complicated and expensive to actuate them mechanically. In the present invention, it has been recognized that a boost provided by vacuum is sufficient to assist in closing the valves at the optimal time in the cycle.

In the preferred embodiment, the vacuum boost is provided by modifying some components of the prior invention, to make additional use of its blower for generating vacuum as well. Of course, the addition of a separate vacuum pump, although more expensive, would be a viable alternative to making use of the blower.

Figure 4:
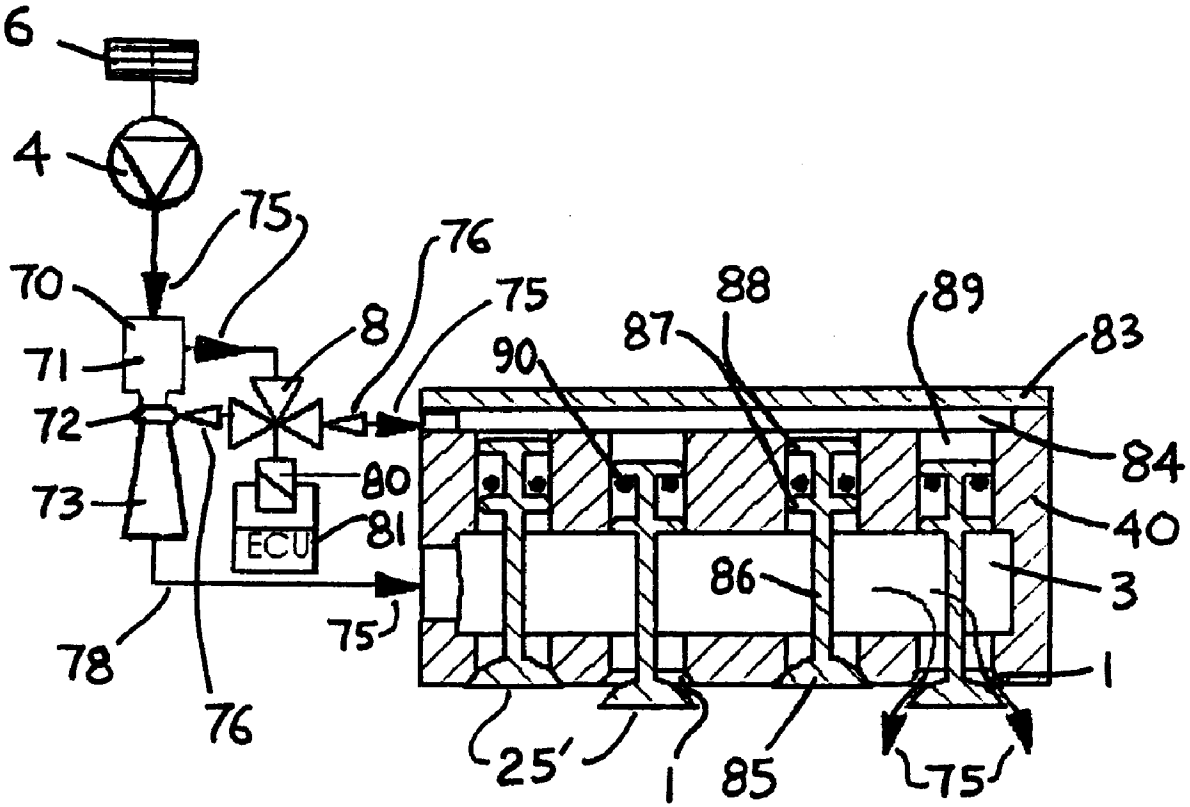
FIG. 4 is a semi-schematic illustration of a cylinder head and auxiliaries in an engine according to the invention.

FIG. 4 illustrates the modifications brought about by this invention relative to the prior invention. The principal parts are listed below:

- intake filter 6
- scavenging blower 4
- Venturi nozzle 70
- pressure chamber of Venturi nozzle 71
- ring chamber of Venturi nozzle 72
- diffuser of Venturi nozzle 73
- dark arrows 75, denoting the flow of pressurized air
- light arrows 76, denoting the flow direction of "vacuum"
- vacuum duct 77
- air supply duct 78
- switch valve 8
- solenoid coil 80
- electronic control unit 81
- multi-valve module, partial cross section; "replaceable unit" 40
- cover lid 83
- vacuum plenum 84
- air supply chamber 3
- valve bore and seat 1
- check bodies 25'
- valve disk 85
- valve shaft 86
- lower and upper guide disks 87, 88
- guide bore 89
- locator pins 90

The functions of the air intake filter 6 and the scavenging blower 4 are apparent.

A variety of blower types can be used, e.g. high speed radial fans as in turbochargers, but powered by a DC electrical motor, as originally suggested in the prior invention, or electrically-powered side channel blowers. Other options are standard exhaust driven turbo chargers or Roots-type blowers, etc.

The latter have been around for more than 100 years and have come a long way in terms of available sizes, reliability, efficiency and last but not least, price. Further, two specific properties make the Roots-type blower the preferred choice: first, it has no built-in compression ratio but pressurizes the air "on demand", which means that it automatically adjusts to the resistance built up in the engine; second, it can be powered by the engine itself via simple means, e.g. a belt drive.

The ducts for pressurized air are denoted by dark arrows 75, indicating the flow direction.

The ducts for "vacuum", actually air with pressure below atmosphere, are denoted by light arrows 76, also indicating flow direction.

The Venturi type nozzle 70 is a simple, cost-effective way for generating the vacuum. In its narrowest section after its pressure chamber 71, it features the ring chamber 72 which the vacuum duct 77 connects to.

The diffuser 73 partially re-establishes the overpressure of the air flowing through and continuing on via air supply duct 78 towards the air supply chamber 3, a part of the multi-valve module 40.

The multi-valve module 40 further accommodates the check bodies 25' (corresponding to but differently configured from the check bodies 25 in the prior invention), the valve bores and seats 1, the guide bores 89, the locator pins 90, the cover lid 83, which establishes the vacuum plenum 84.

Not shown in FIG. 4, the multi-valve module 40 features also the threaded bores 27, 28 for the spark plug and the fuel injection nozzle. However, the fuel injector could also be positioned to reach the combustion chamber from the side at the top of the cylinder, thereby not passing through the valve module.

Figure 5:
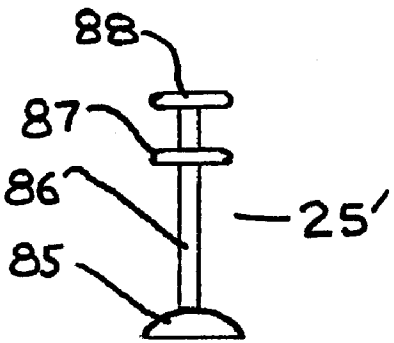
FIG. 5 is a side view of one of the valves according to the invention.

For purposes of illustration, the check bodies 25' are depicted in two positions in FIG. 4, though in operation all check bodies associated with a given cylinder of course would be in the same position at any given time. Two are shown closed, and the other open, with arrows 75 indicating the air flow during the scavenging phase. FIG. 5 illustrates a single check body 25'.

The essential component assisting with these position changes is the switch valve 8. It is a three-way two-position valve, actuated by the solenoid coil 80, which in turn is controlled by the electronic control unit (ECU) 81. The three-way configuration makes it possible to manipulate the valve opening as well in a controlled and even programmable manner.

According to the invention, the preferred check bodies have the shape of mini poppet valves with a spherical segment as the valve disk 85, the valve shaft 86 and the lower and upper guide disks 87 and 88 respectively, the guide disks acting in pairs also as actuating pneumatic pistons. The guide bores 89 act as pneumatic cylinders. The clearance between a pair of guide disks 87, 88 and the guide bore 89 can be made quite generous due to the self-aligning effect of the valve disks 85, allowing for some minor air leakage between the air supply chamber 3 and the vacuum plenum 84. This in turn provides for lubrication by air of the guide disks 87, 88, allowing for their simple and low cost design.

The operation of the invention can be described as follows:

The scavenging blower 4 runs all the time with the engine, generating the scavenging air flow. If directly driven, its delivery is governed by the engine; if indirectly driven, e.g. by a DC motor, it is speed controlled by the ECU 81.

The Venturi nozzle 70, with its ring chamber 72, generates the required vacuum.

The diffuser 73 partially restores the overpressure of the air and delivers it, via duct 7 to the air supply chamber 3.

When a check body 25 is open, scavenging air flows into the cylinder as indicated by arrows 75. Of course, the sequence of events is controlled by the ECU 81, with particular events, parameters or set points programmable. Thus for instance, the timing for the valves to open and close, and the times for fuel injection and ignition can be optimized so that power output, fuel economy and emissions will be optimized.

With the valve disks 85 of the check bodies 25' shaped like spherical segments, a self-aligning effect will be achieved, which allows for the low cost design already mentioned. At the same time a perfectly smooth surface of the cylinder head is achieved, contributing to a "clean" combustion chamber when the valves are closed.

The locator pins 90 limit the down travel of the check bodies 25', when they are hit by the upper guide disks 88. The uppermost position of the check bodies 25' is defined by the valve disks 85 settling into their seats 1, with the valve shaft 86 providing the necessary firm connection.

In a one-cylinder engine there is only one of each item as listed above, except for the multitude of check bodies 25'. In engines with X number of cylinders, there will be X number of each item on the above list, except the intake filter 6, blower 4, Venturi nozzle 70 and ECU 81.

Further variations may be apparent or become apparent to those knowledgeable in the field of the invention, and are within the scope of the invention as defined by the claims which follow.

The invention will facilitate the creation of a two-stroke engine which should be able to compete with the most modern four-stroke engines in terms of performance, emission standards, specific fuel consumption and other relevant parameters, while retaining the traditional advantages of the two-stroke engine: smaller, lighter, simpler, more cost-effective. The addition of a controlled and programmable valve activating system to the prior invention, according to this invention, will facilitate variable valve timing and partial selective cylinder cut-off. The engine, with very flexible valve timing, will also be able to operate with variable displacement according to load conditions further improving overall fuel economy. To save fuel during extreme low load application, it could also switch from two-stroke to four-stroke mode operation with great advantages over the individual cylinder shut-off methods currently developed/implemented by manufacturers of large displacement four-stroke engines. The programmable check valve activation will provide for outstanding engine flexibility.

INDUSTRIAL APPLICABILITY

The invention allows a two-stroke engine to arrive at a level of efficiency, fuel economy, and emission quality of a comparable four-cycle engine, but with a smaller, simpler, lighter, and more economical power plant.

The invention claimed is:

1. In a two-stroke internal combustion engine, having an engine block defining at least one cylinder with a piston mounted therein for reciprocal motion between a top position and a bottom position, wherein each said cylinder has an intake port and at least one air intake valve coupled to said cylinder, to allow air into the top of said cylinder, and at least one exhaust port at a lower position above said bottom position of said piston;

and having a blower arranged to force air into each said cylinder via each said intake valve as said piston moves around said bottom position, said blower not supplying enough pressure to keep each said intake valve open during upward motion of said piston, such that during upward motion of said piston, compression occurs within said cylinder, and such that during downward motion of said piston said blower forces air into each said cylinder via each said intake valve once each said exhaust port is uncovered by said downward motion, and out of each said cylinder via each said exhaust port;

the improvement wherein each said intake valve is positively actuated by controlled air pressure differentials, wherein the air pressure differentials are controlled by an electronic control unit operating a solenoid switch valve to apply said pressure differentials according to desired cylinder valve timing.

2. An engine as in claim 1, wherein there are multiple said air intake valves for each said cylinder.

3. An engine as in claim 2, wherein multiple air intake valves are arranged in a replaceable unit.

4. An engine as in claim 1, wherein the solenoid switch valve is provided with at least one duct connected to a source of air with pressure below atmosphere for creating a partial vacuum.

5. An engine as in claim 4, wherein said partial vacuum is produced by a Venturi nozzle arrangement connected to said blower.

6. An engine as in claim 1, wherein each said air intake valve comprises a valve disk to close against a valve seat, a valve shaft, and lower and upper guide disks, said lower and upper guide disks running in guide bores and acting as actuating pneumatic pistons, said guide bores extending between an air supply chamber receiving air from said blower and a vacuum plenum, said guide disks thereby responding to a pressure differential between said vacuum plenum and said air supply chamber to actuate said valve.

7. A two-stroke internal combustion engine comprising:

an engine block with at least one cylinder bore formed therein bounded by a cylinder head at one end and at the other end by a piston mounted therein for reciprocal motion between a top position and a bottom position;

wherein the cylinder head has as formed therein at intake port in communication with the cylinder bore at least one exhaust port oriented in the cylinder bore below the intake port and above the bottom position of the piston, the cylinder head further defining an intake valve plenum and associated intake valve guide bore;

an intake valve movably cooperating with the cylinder head and shiftable between an open and closed position, the intake valve having a valve disc oriented within the cylinder head and movable between a closed position in cooperation with the cylinder head and an open position spaced therefrom to allow air to flow between the intake port and the cylinder, the intake valve further having a valve guide disc spaced from the valve disc which sealingly cooperates with the guide bore and the cylinder head; the valve guide disc having a surface exposed to the intake port and an opposed surface exposed to the valve plenum;

a blower arranged to force air into the cylinder via the intake port and the intake valve as the piston moves downwardly towardly to the bottom position, the blower not supplying enough pressure to maintain the intake valve open as the piston moves upward compressing the air within the cylinder and such, that during the downward motion of the piston, once the exhaust port is uncovered by the downward motion of the piston, the pressure of the air in the intake port acting upon the valve disc and the valve guide and the pressure of the air in the valve plenum acting on the opposed surface of the valve guide, is sufficient to open the intake valve allowing air to flow from the intake port into the cylinder;

an air pressure valve for controlling the pressure or vacuum of an air supply to the valve plenum; and an electronic controller for regulating the air pressure valve to control the pressure in the valve plenum to achieve a desired intake valve timing.

* * * * *